US007641487B2

(12) United States Patent
Morgan

(10) Patent No.: US 7,641,487 B2
(45) Date of Patent: Jan. 5, 2010

(54) CONNECTION DEVICE

(75) Inventor: Trevor Ronald Morgan, Bristol (GB)

(73) Assignee: Vetco Gray Controls Limited, Nailsea, Bristol (GB)

( * ) Notice: Subject to any disclaimer, the term of this patent is extended or adjusted under 35 U.S.C. 154(b) by 117 days.

(21) Appl. No.: 11/918,974

(22) PCT Filed: Mar. 21, 2006

(86) PCT No.: PCT/GB2006/001009

§ 371 (c)(1),
(2), (4) Date: Oct. 22, 2007

(87) PCT Pub. No.: WO2006/114566

PCT Pub. Date: Nov. 2, 2006

(65) Prior Publication Data

US 2009/0042422 A1 Feb. 12, 2009

(30) Foreign Application Priority Data

Apr. 26, 2005 (GB) ..... 0508382.9

(51) Int. Cl.
*H01R 13/62* (2006.01)

(52) U.S. Cl. ..... 439/158; 439/953; 439/194; 441/4; 294/82.3; 294/66.1

(58) Field of Classification Search ..... 439/158, 439/953, 194, 191, 259, 372; 441/4, 3, 5; 294/82.3, 66.1, 82.35
See application file for complete search history.

(56) References Cited

U.S. PATENT DOCUMENTS

| | | | | | |
|---|---|---|---|---|---|
| 1,412,384 | A | * | 4/1922 | Brown | 213/1.6 |
| 3,585,567 | A | * | 6/1971 | Wofford | 439/158 |
| 3,635,184 | A | | 1/1972 | Liautaud | |
| 3,649,952 | A | * | 3/1972 | Harmon | 439/158 |
| 3,835,441 | A | * | 9/1974 | Harmon | 439/184 |
| 4,354,398 | A | * | 10/1982 | Porter | 74/501.6 |
| 4,669,791 | A | * | 6/1987 | Savill | 439/34 |
| 5,329,693 | A | * | 7/1994 | Smith | 29/764 |
| 5,620,330 | A | | 4/1997 | Pizon | |
| 6,203,349 | B1 | | 3/2001 | Nakazawa | |
| 2006/0231266 | A1 | * | 10/2006 | Rodrigues et al. | 166/365 |

FOREIGN PATENT DOCUMENTS

| | | | |
|---|---|---|---|
| EP | 1133016 | A2 | 9/2001 |
| GB | 0859166 | A | 2/1959 |
| GB | 1114384 | A | 5/1968 |
| GB | 2218577 | A | 11/1989 |

* cited by examiner

*Primary Examiner*—Gary F. Paumen
(74) *Attorney, Agent, or Firm*—Bracewell & Giuliani LLP

(57) ABSTRACT

A cable connection device (7) for operatively connecting two sections of cable (3) (see FIG. 1) comprises: first and second parts (9, 10) for respective connection to the first and second cable sections, said first and second parts (9, 10) having mutually engageable components (15, 16) for releasably locking the two parts together; and a release mechanism (17, 19, 31) which when activated permits the first and second parts to separate, said mechanism comprising means (31) for forcibly separating the first and second parts.

15 Claims, 3 Drawing Sheets

CONNECTION DEVICE

RELATED APPLICATION

Figure 1:
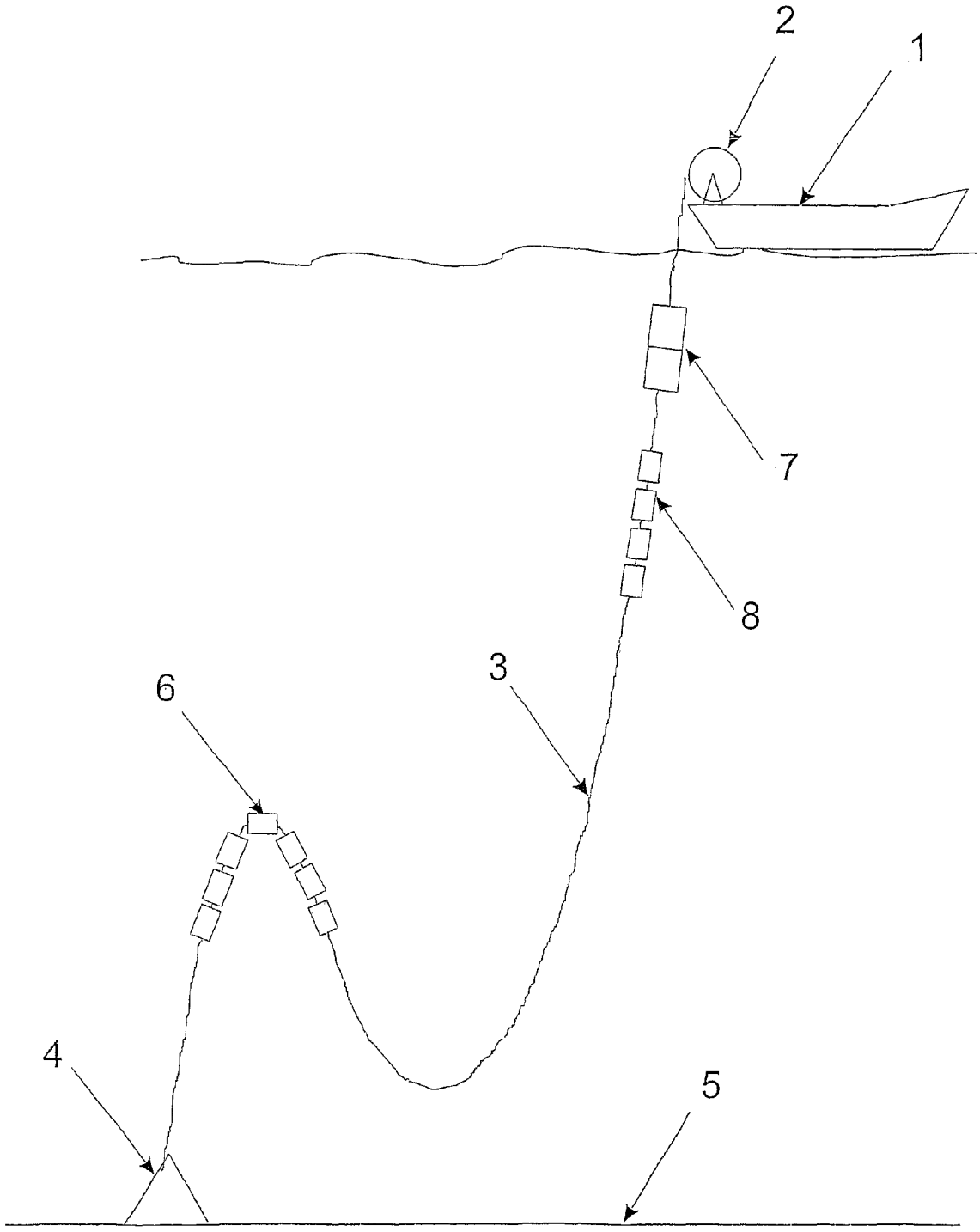

This application claims priority to PCT application PCT/GB2006/001009, filed Mar. 21, 2006, which claimed priority to United Kingdom Patent Application No. 0508382.9, filed Apr. 26, 2005.

The present invention relates to a cable connection device for operatively connecting two sections of cable and an underwater system including such a device.

Underwater facilities, for example subsea hydrocarbon wells, are conventionally controlled via a long umbilical cable extending between the facility and a surface base. The umbilical cable may be used to supply both electrical and hydraulic control signals to the well. However, there are occasions when the umbilical cable fails. Under these circumstances, a back-up system to temporarily restore power and control to the well complex is employed. There are a variety of systems that subsea fluid extraction equipment suppliers have produced with variable success. They are mainly designed to be operated from a vessel of opportunity carrying a drum loaded with an umbilical cable, which is deployed by a crane/winch, typically from the stern of the vessel and a local source of electric and hydraulic power along with a well complex control system. This power and control system is typically mounted on a skip which can then be easily fitted and removed from the vessel of opportunity.

In a typical deployed back-up intervention system, the profile of the deployed umbilical cable to the well is important as the system has to survive the movement of the vessel in severe weather conditions and cope, typically, with peak wave conditions resulting in the heave at the vessel stern as high as 21 meters. To establish the correct profile the umbilical cable is fitted with collars in suitable positions along the length of the umbilical cable and this buoyancy system is designed to allow the collars to be part of the umbilical cable when it is wound on the drum. This avoids having to fit them to the umbilical cable when it is deployed, and thus making the deployment process much more rapid. Furthermore, since the dead-weight of an umbilical cable can be typically 43 tons, the collars make a contribution to reducing the effective weight seen by the vessel stern. Thus the collars are designed to have 'neutral buoyancy' when they are deployed along with the effective umbilical cable weight, i.e. after subtraction of the 'buoyancy' due to water displacement of the umbilical cable itself. The umbilical cable is fitted with a connector at the subsea end, designed to be mated at the well complex, by a Remote Operated Vehicle (ROV). A further connector is required, inserted in the umbilical cable, close to the vessel, to allow quick disconnection in an emergency, such as peak waves exceeding the design limits, or snagging of the umbilical cable. It is this aspect of the existing back-up intervention equipment which has been the least successful since they have been prone to either disconnect when not required to do so or, equally disastrously, fail to disconnect when required. This is mainly due to inadequate consideration of the forces involved, not only due to the load of the umbilical cable trying to part the connection, but the forces required to part the connector in an emergency when operating at sea temperatures as low as minus eighteen degrees centigrade, which can result in ice locking the connector halves together.

It is an aim of the present invention to overcome these problems by the introduction, in the umbilical cable, of a novel connection device or "Emergency Quick Disconnect Package" (EQDP) which takes such forces into consideration and will thus function reliably under severe sea states and low temperatures.

The interface of an EQDP consists of two mating stab plate halves, each carrying a multiplicity of mating connectors carrying hydraulic and electric power and control signals, which must separate when required.

Thus the primary requirements of an EQDP are:

A) The stab plate halves must not inadvertently release.

B) It must react to all loads and moments coming into it from the umbilical cable without any separation.

C) The emergency parting of the stab plate halves must be guaranteed and in all environmental conditions, e.g. temperature, icing, sea state, and water depth.

D) It must remain fully functional in all the above environmental conditions.

E) It must connect all power and control functions between the vessel mounted power and control system and a dynamic umbilical cable.

F) After emergency quick disconnection (EQD), the dropped half must survive in the sea until recovered.

G) Release is to be effected within a defined radius circle, typically 95 m.

The present invention meets these requirements by utilising a positive lock between the stab plate halves and by employing at least two independent methods of release.

Prior art methods of securing and emergency releasing, of the two halves of an EQDP are notoriously unreliable. They are well known to part when not necessary, since the method as securing the two halves of an EQDP have been a compromise between separation, when essential, to protect the umbilical cable, and securing under weather conditions which, although severe, are workable. Thus existing mechanisms do not employ positive locking between the EQDP halves, i.e. they typically use a 'spring clip' type of engagement. The result is frustration and substantial recovery costs for the back-up intervention operator. This invention not only overcomes the lack of positive locking but at the same time still provides a fully controllable quick release. Furthermore it may also provide a 100% back-up in the event of failure of the normally used quick release mechanism, and neither of these release methods compromise the positive locking.

According to a first aspect of the present invention, there is provided a cable connection device for operatively connecting two sections of cable, the device comprising:

first and second parts for respective connection to the first and second cable sections, said first and second parts having mutually engageable components for releasably locking the two parts together; and a release mechanism which when activated permits the first and second parts to separate, said mechanism comprising means for forcibly separating the first and second parts.

The engagement and disengagement of the components may be manually controllable.

The engageable components preferably comprise male and female members respectively. The distance between the members may be adjustable. The members may be configured such that the members are relatively rotatable between first and second positions, and wherein engagement of the members is only possible substantially at said first position. The members when engaged may be locked by rotation toward said second position. The female member may be releasably attached to one of the parts.

Preferably, the release mechanism when activated permits the separation of the first and second parts without disengagement of the engageable components. The release mechanism when activated may detach the female member from its respective part. This detachment may be hydraulically controllable.

Advantageously, the means for forcibly separating the first and second components comprises hydraulic actuators.

Preferably, a second release mechanism is provided, comprising additional means for forcibly separating the first and second parts. This second release mechanism when activated may force relative rotation of the members to permit their disengagement. The additional means for forcibly separating the first and second components may comprise hydraulic actuators.

Advantageously, the device is suitable for use underwater.

Advantageously, the cable sections carry at least one of hydraulic and electric lines.

According to a second aspect of the invention, there is provided an underwater system comprising a cable for carrying electric and/or hydraulic signals, the cable including a connection device for connecting two sections of the cable, wherein the connection device comprises two parts, each for connection to a respective section, such that in normal operation the two parts are locked together, the device further comprising means for forcibly separating the parts.

A preferred embodiment of the invention will now be described with reference to the accompanying drawings, in which—

Figure 2:
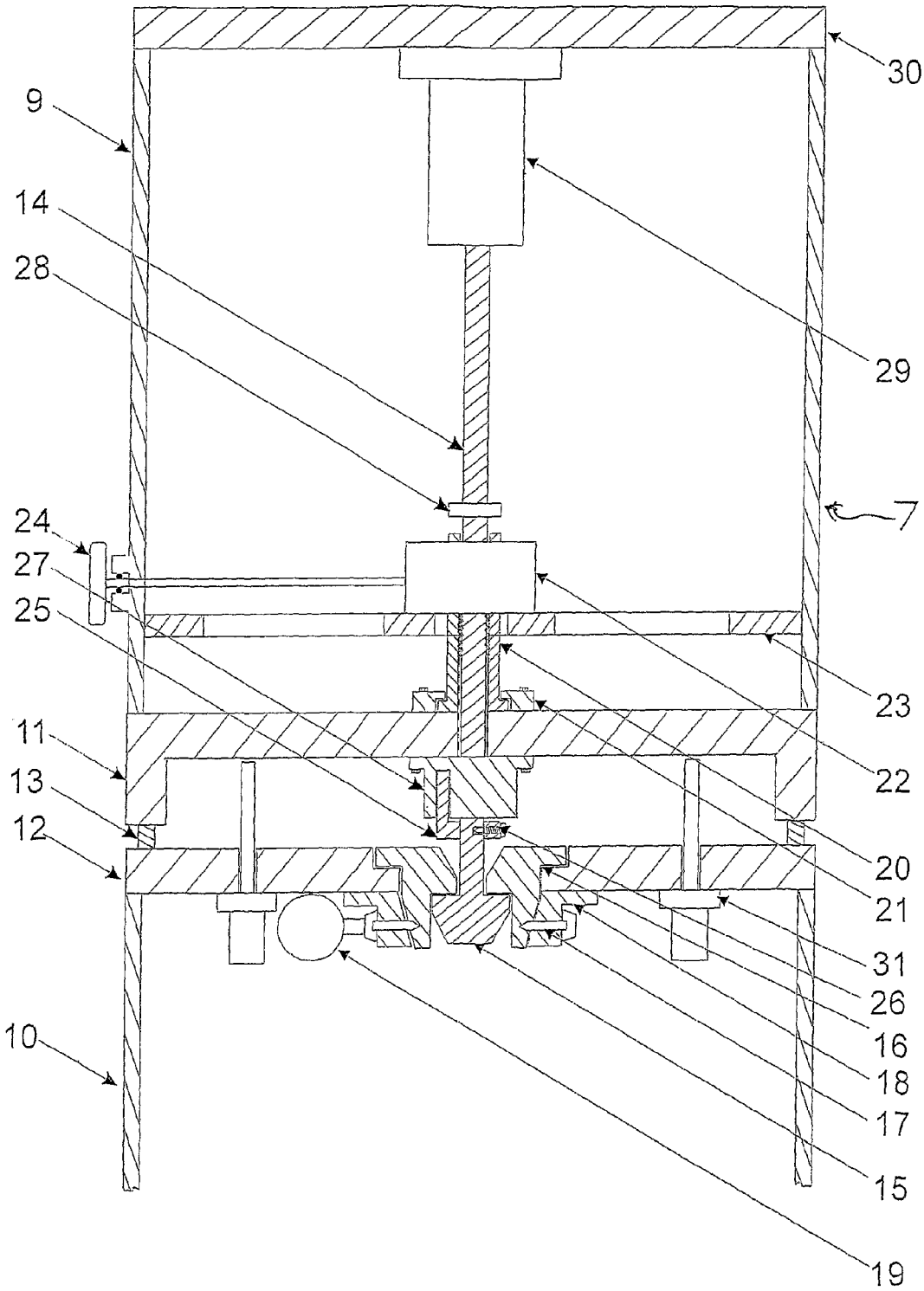
Figure 3:
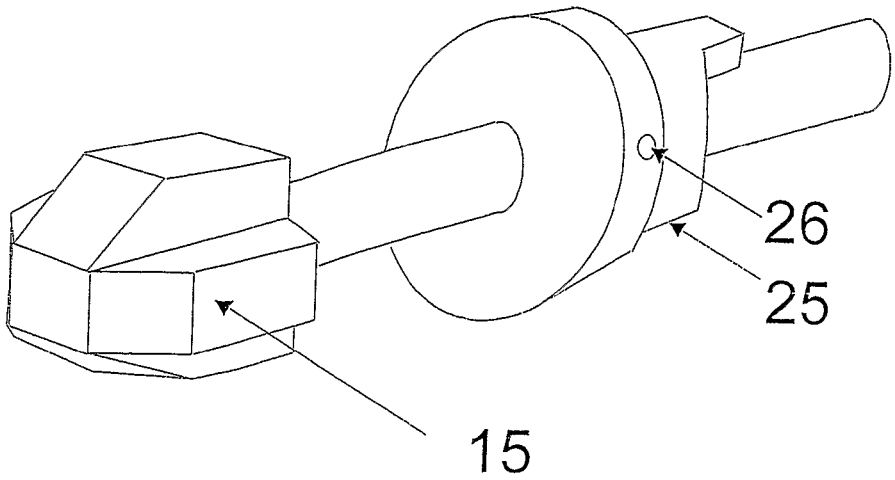
Figure 4:
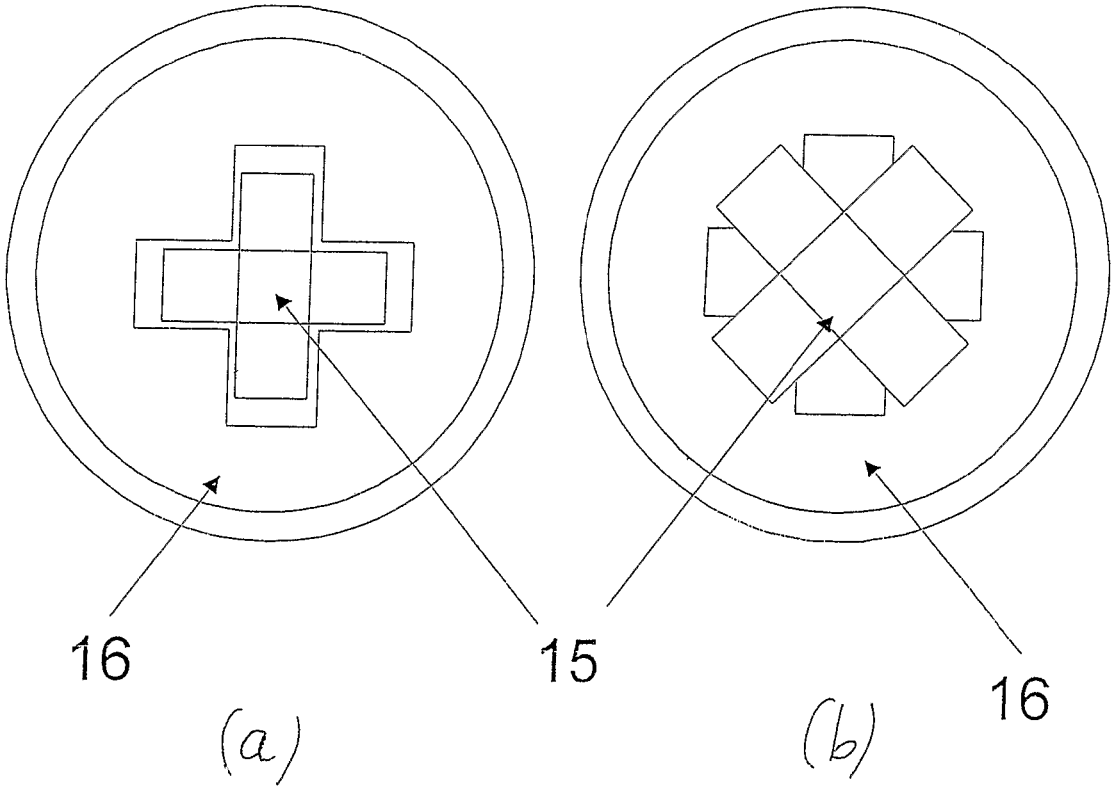

FIG. 1 schematically shows a typically deployed back-up intervention umbilical arrangement;

FIG. 2 schematically shows a mostly sectional view of a disconnect package in accordance with the present invention;

FIG. 3 schematically shows a perspective view of the positive latch cruciform/anchor plate arrangement and cam tube used in the apparatus of FIG. 2; and FIGS. 4*a* and *b* schematically show in plan view the cruciform mating arrangement used in the apparatus of FIG. 2.

FIG. 1 illustrates the function of an EQDP with an arrangement of a vessel of opportunity 1, with a drum 2, that carried an umbilical cable 3, prior to its deployment. The umbilical cable 3 feeds back-up hydraulic, electric and control supplies to the well complex 4, on the seabed 5. The profile of the umbilical cable 3 is maintained by the flotation collars 6. The EQDP 7 is located close to the vessel. To aid recovery of the lower half of the EQDP after an emergency disconnect, further collars 8 are typically fitted to the umbilical cable below it, so that it does not sink to the seabed, where its recovery would be much more difficult.

FIG. 2 illustrates diagrammatically a sectioned view of an EQDP in accordance with the present invention. The EQDP is shown in the 'locked together' position and consists of an upper half part 9 and a lower half part 10. The interface between them is formed by stab plates 11 and 12, which permit electrical and/or hydraulic connection between the umbilical cable sections on each side of the EQDP. A flexible seal 13 is provided between the two parts 9 and 10. The mechanism that clamps and releases the stab plates 11 and 12 consists of a shaft 14, with a male cruciform end 15 (see also FIG. 3). This matches a female cruciform in an anchor plate 16, which is secured to the lower stab plate 12 by the pins 17, in a proprietary, hydraulically-operated, dog-latch 18. The dog-latch 18 is operated by a hydraulic ram 19. The shaft 14 is part threaded, on to which a threaded flanged tube 20 is screwed. The tube 20 is secured to the upper stab plate 11 by a flanged collar 21, such that it is able to rotate but not move axially vertically. The tube 20 is attached to a gearbox 22, for example of worm and pinion type, not shown sectioned, attached to a support plate 23. This is manually operable by a handwheel 24. A cam tube 25 is also secured to the shaft 14 by means of a shear pin 26. The upper face of this cam tube 25 is machined at a shallow angle (see also FIG. 3) and mates against a matching angled face, machined in a collar 27 which is attached to the stab plate 11. Built-in stops in the collar 27 limit the rotation of the cam tube 25 to about forty-five degrees. The shaft 14 is fitted with a 'back stop nut' 28 and is also splined to the output shaft of an axial to rotary hydraulic actuator 29, not shown sectioned, that allows axial movement of the shaft 14. The hydraulic actuator 29 is mounted on a back plate 30 of the upper half 9 of the EQDP. Four hydraulic rams 31, not shown sectioned, are mounted symmetrically around the stab plate 12, only two of which are visible in FIG. 2. Two diametrically opposite hydraulic rams 31 and the hydraulic dog latch 18 are all fed with a single hydraulic feed. This is fed via a hydraulic connector between the EQDP halves, not shown, and powered via the umbilical to the vessel from a hydraulic pressure source, typically housed in a skip, mounted on the vessel, i.e. the "primary release" hydraulic power source. The other two hydraulic rams 31 and the hydraulic actuator 29 are all fed from a separate hydraulic power source, via a separate feed through the umbilical cable to the vessel, i.e. the "secondary release" hydraulic power source, typically mounted in the same skip as the primary hydraulic source. This arrangement provides a back-up release system.

Although the purpose of an EQDP, in normal operation, is to mate a multiplicity of connectors, mounted on the stab plates 11 and 12, to transmit hydraulic fluid, electric power and control signals, between the two halves of the EQDP 9 and 10, they have not been shown on FIG. 2 for clarity, since they do not substantially affect the engagement or release functions of the inventive connection device. Likewise the umbilical cable feeding to and from the EQDP is also not shown.

The operation of the positive latching of the two halves of the EQDP is as follows:

When the two halves of the EQDP 9 and 10 are first brought together, the cruciform end of the shaft 14 protrudes from the stab plate 11. The cruciform 15 aligns with the female cruciform in the anchor plate 16, as shown in FIG. 4*a*, such that as the two halves are mated the male cruciform passes through the female cruciform in the anchor plate 18. The hand wheel 24 is rotated so that, through the gearbox 22, the threaded tube 20 rotates. Since this tube 20 is constrained from axial movement by its flange and the collar 21, the shaft 14 moves axially, i.e. vertically as shown in FIG. 2 with the hand wheel rotated in the appropriate direction. Lifting of the shaft 14 engages the cam tube 25 with the collar 27 and due to the angled faces of both, forces the shaft 14 and its cruciform end 15 to rotate out of alignment with the female cruciform in the anchor plate 16 to the position shown in FIG. 4*b*, whilst with continued rotation to draw together the stab plates 11 and 12 and compressing the flexible seat 13. The high mechanical advantage of the gearbox 22 easily permits a tight clamping by hand without the need for tools. A sketched view of the cam tube 25 is also shown in FIG. 3. The rotation of the shaft 14 and its cruciform end 15 is limited to 45 degrees by the end stops built into the collar 25. The process results in the positive clamping together of the two halves of the EQDP.

To separate the two EQDP halves, the hand wheel 24 is rotated in the reverse direction so that the tube 20 rotates and drives the shaft 14 downwards, until the back stop nut 28 engages with the end of the tube 20. Further rotation of the hand wheel 24 then forces the shaft 14 to rotate, but it is limited to about forty-five degrees by the cam tube 25 and collar 27 assembly design, thus aligning the cruciform 15 with the female cruciform in the anchor plate 16 to the position shown in FIG. 4*a* and allowing separation of the EQDP halves 9 and 10. Since this release mechanism is hand-operated it has no involvement in any emergency release and is used for deployment and recovery only.

The operation of the primary Emergency Quick Release mechanism is as follows:

When an emergency quick disconnect is required, the primary release hydraulic supply from the skip on the vessel, feeding the hydraulic actuator 19 and two of the rams 31, is energised. This releases the dog-latch 18 allowing the anchor plate 16 to detach from the stab plate 12, whilst the two hydraulic rams 31 push the stab plates 11 and 12 apart. Thus the two halves of the EQDP are separated, with the anchor plate still attached to the shaft 14 and cruciform 15. The EQDP lower half can then be recovered and the EQDP easily re-assembled when conditions permit. Although the weight of the umbilical cable between the flotation collars 8 and the EQDP 7 is normally sufficient to part the EQDP, in the case of low temperatures where icing may prevent this occurring, the two hydraulic rams 31 ensure that parting of the EQDP halves is rapidly achieved.

The operation of the secondary Emergency Quick Release mechanism is as follows:

If, for any reason, the primary quick release mechanism fails, the secondary or back-up mechanism is operated. In this case, referring to FIG. 2, the secondary hydraulic feed to the axial to rotary hydraulic actuator 29, which also feeds the second pair of hydraulic rams 31, is energised. The actuator 29 is coupled to the shaft 14 such that when the hydraulic supply is energised, the actuator 29 endeavours to forcefully further rotate the shaft 14 in the locking direction. However the rotation of the shaft 14 has been previously limited to about forty-five degrees by the cam tube 25 and the collar 27. The relatively high torque of the hydraulic actuator 29 results in the shearing of the shear pin 26, thus permitting the shaft 14 to further rotate by about forty-five degrees. At the same time, the second pair of hydraulic rams 31 are endeavouring to part the stab plates 11 and 12. When the male cruciform 15, on the end of the shaft 14, becomes aligned with the female cruciform in the anchor plate 26, it slips through the anchor plate, assisted by the force of the rams 31, allowing the parting of the stab plates 11 and 12 and thus release of the two halves 9 and 10 of the EQDP. Again, any icing at low temperatures is overcome by the hydraulic rams 31. Tests on a prototype assembly have shown that the secondary release mechanism takes less than two seconds to complete its release cycle. When the lower half of the EQDP is recovered it cannot be rapidly re-assembled to the upper half, following use of this back-up release system, since the shear pin 26 has to be replaced first. However, since this pin is located in the upper half of the EQDP, which is still attached via the short section of umbilical to the vessel, it is easily recovered, allowing its relatively straightforward replacement.

It should be noted that the above description describes an exemplary embodiment only. Other alternatives will be obvious to those skilled in the art within the scope of the claims. For example, the shaft 14 need not have a cruciform end, but any shape, apart from circular, may be used.

The invention claimed is:

1. A cable connection device for operatively connecting two sections of cable, the device comprising:

first and second parts for respective connection to the first and second cable sections, said first and second parts having mutually engageable components for releasably locking the two parts together;

a first release mechanism which when activated permits the first and second parts to separate, said mechanism comprising means for forcibly separating the first and second parts; and a second release mechanism comprising hydraulic actuators for forcibly separating the first and second parts.

2. A connection device according to claim 1, wherein the engagement and disengagement of the components is manually controlled.

3. A connection device according to claim 1, wherein the engageable components comprise male and female members respectively.

4. A connection device according to claim 3, wherein the distance between the members is adjustable.

5. A connection device according to claim 3, wherein the members are configured such that the members are relatively rotatable between first and second positions, and wherein engagement of the members is only possible substantially at said first position.

6. A connection device according to claim 5, wherein the members when engaged may be locked by rotation toward said second position.

7. A connection device according to claim 3, wherein said female member is releasably attached to one of the parts.

8. A connection device according to claim 1, wherein the release mechanism when activated permits the separation of the first and second parts without disengagement of the engageable components.

9. A connection device according to claim 8, wherein the engageable components comprise male and female members respectively, wherein said female member is releasably attached to one of the parts and wherein the release mechanism when activated detaches the female member from its respective part.

10. A connection device according to claim 9, wherein the detachment is hydraulically controlled.

11. A connection device according to claim 1, wherein the means for forcibly separating the first and second components comprises hydraulic actuators.

12. A connection device according to claim 1, wherein the second release mechanism when activated forces relative rotation of the members to permit their disengagement.

13. A connection device according to claim 1, for use underwater.

14. A connection device according to claim 1, wherein the cable sections carry at least one of hydraulic and electric lines.

15. A connection device according to claim 1, wherein the cable carries electric and/or hydraulic signals, the connection device connecting two sections of the cable, each of the first and second parts being connected to a respective section of cable, such that in normal operation the two parts are locked together.

* * * * *